US008585105B1

(12) United States Patent
Dobbins, Sr.

(10) Patent No.: US 8,585,105 B1
(45) Date of Patent: Nov. 19, 2013

(54) MOVABLE ELECTROMAGNETIC LOCK ASSEMBLY

(76) Inventor: Vincent A. Dobbins, Sr., Glen Burnie, MD (US)

( * ) Notice: Subject to any disclaimer, the term of this patent is extended or adjusted under 35 U.S.C. 154(b) by 968 days.

(21) Appl. No.: 12/592,572

(22) Filed: Nov. 30, 2009

(51) Int. Cl.
*E05C 17/56* (2006.01)

(52) U.S. Cl.
USPC ..... 292/251.5; 49/360

(58) Field of Classification Search
USPC ..... 292/251.5; 49/360, 31, 260
See application file for complete search history.

(56) References Cited

U.S. PATENT DOCUMENTS

| | | | | |
|---|---|---|---|---|
| 3,354,581 | A | 11/1967 | Dimmitt et al. | |
| 4,050,189 | A * | 9/1977 | Peterson | 49/26 |
| 4,439,808 | A * | 3/1984 | Gillham | 361/144 |
| 4,487,439 | A | 12/1984 | McFadden | |
| 4,562,665 | A | 1/1986 | Blackston | |
| 4,826,223 | A | 5/1989 | Geringer et al. | |
| 4,840,411 | A * | 6/1989 | Sowersby | 292/251.5 |
| 4,981,312 | A | 1/1991 | Frolov | |
| 4,986,581 | A | 1/1991 | Geringer et al. | |
| 5,000,497 | A | 3/1991 | Geringer et al. | |
| 5,006,723 | A | 4/1991 | Geringer et al. | |
| 5,016,929 | A | 5/1991 | Frolov | |
| 5,033,779 | A | 7/1991 | Geringer et al. | |
| 5,133,581 | A | 7/1992 | Coleman | |
| 5,641,187 | A | 6/1997 | Frolov | |
| 5,692,786 | A | 12/1997 | Berger | |
| 6,007,119 | A | 12/1999 | Roth et al. | |
| 6,135,515 | A * | 10/2000 | Roth et al. | 292/251.5 |
| 6,170,195 | B1 * | 1/2001 | Lim | 49/196 |
| 6,260,892 | B1 | 7/2001 | Chang | |
| 6,561,555 | B1 * | 5/2003 | Millard | 292/251.5 |
| 6,722,715 | B1 | 4/2004 | Chiang | |
| 6,758,504 | B2 | 7/2004 | Mandall | |
| 6,880,868 | B2 | 4/2005 | Brami et al. | |
| 2008/0250716 | A1 * | 10/2008 | Ranaudo et al. | 49/31 |
| 2009/0044916 | A1 * | 2/2009 | Singiser et al. | 160/201 |
| 2012/0144748 | A1 * | 6/2012 | Ranaudo et al. | 49/260 |

* cited by examiner

*Primary Examiner* — Shane Bomar
*Assistant Examiner* — Mark Williams
(74) *Attorney, Agent, or Firm* — Tipton L. Randall

(57) ABSTRACT

An electromagnetic lock assembly locks sliding double doors having abutting edges when closed. The lock assembly includes an armature plate member mounted through an L-shaped bracket member to a first sliding door adjacent an abutting edge thereof. An electromagnetic body member is mounted through another L-shaped bracket member to a second sliding door adjacent an abutting edge thereof. The armature plate member and electromagnetic body member are in register contact with the sliding double doors closed. The electromagnetic body member includes an electrical conductor portion movably contacting a stationary, linear power strip member mounted to a nonmoving support adjacent to the second sliding door. Electrical power is maintained to the electromagnetic body member of the lock assembly by the electrical conductor portion thereof, movably contacting the stationary power strip member upon movement of the sliding double doors.

17 Claims, 9 Drawing Sheets

MOVABLE ELECTROMAGNETIC LOCK ASSEMBLY

CROSS-REFERENCE TO RELATED APPLICATIONS, IF ANY

Not applicable.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates to a door lock and, more particularly, to an electromagnetic door lock and, most particularly, to an electromagnetic door lock for a sliding double door.

2. Background Information

Existing sliding double automatic doors can be added to an access control system, but with limited functions. The sliding double automatic doors are opened and closed remotely by using a programmed timed schedule in the software for such a system. Usually, it is easy to control the opening and closing of a sliding double door. However, closing the sliding double door does not lock the doors. Although the sliding double doors are closed, they can be forced open. Magnetic locks can be installed on a single automatic door, but installation is extremely difficult because the electronics in the door can be damaged during installation. Therefore, careful drilling of the door is required to install the magnetic lock.

All electromagnetic locks are designed for mounting to a stable, non-moveable, door frame. The electromagnetic lock includes an electromagnet portion secured to the door frame and an armature plate or strike plate portion secured to the door. The electromagnet portion has a power cord to selectively power the electromagnet and does not move. The strike plate or armature plate is secured to the door and moves with operation of the door. The electromagnet portion and strike plate portion are mounted either horizontally or vertically to the door and door frame, respectively. When vertical mounted to a hinged door, the faces of two portions of the electromagnetic lock slide across each other as the portions come into alignment prior to locking. This orientation is termed a "shear lock" and special features are designed into the lock to ensure proper alignment and locking. When horizontally mounted, with the electromagnetic portion extending beyond the door frame, the faces of two portions of the electromagnetic lock approach in register as the portions come into alignment prior to locking. Thus, no special features are required to ensure proper alignment and locking.

Single sliding doors can employ electromagnetic locks in the vertical orientation, with the two faces of the portions approaching in register. Electromagnetic locks are seldom installed on sliding double automatic doors because both doors move away from each other in operation, and the sliding doors have an aluminum access panel above the two doors that is fabricated from very thin metal, which provides little support for an electromagnetic lock system. The access panel encloses the door's operating parts and usually lifts up to access these movable parts. To date, in order to lock this type of sliding double doors, an individual must physically lock the doors with a key. This task is eliminated if magnetic locks (solidly installed) are employed. If the locks are vertically installed, the doors are solidly locked until de-energized. Currently this could be done, but is not, because a long cord is required for connection from the lock to the corner of the door. Because both the doors move and the magnetic lock requires a stationary surface, installation is not practical or possible. Only the strike plate is designed to move. The present invention eliminates this problem and allows both the strike plate and magnetic lock to move, thus providing automatic locking of both doors without a key.

Electromagnetic door locks are well known and a number of innovations concerned with electromagnetic door locks have been granted patents. These patents include U.S. Pat. No. 3,354,581 by Dimmitt et al.; U.S. Pat. No. 4,487,439 by McFadden; U.S. Pat. No. 4,562,665 by Blackston; U.S. Pat. No. 4,826,223 by Geringer et al.; U.S. Pat. No. 4,840,411 by Sowersby; U.S. Pat. No. 4,981,312 by Frolov; U.S. Pat. No. 4,986,581 by Geringer et al.; U.S. Pat. No. 5,000,497 by Geringer et al.; U.S. Pat. No. 5,006,723 by Geringer et al.; U.S. Pat. No. 5,016,929 by Frolov; U.S. Pat. No. 5,033,779 by Geringer et al.; U.S. Pat. No. 5,133,581 by Coleman; U.S. Pat. No. 5,641,187 by Frolov; U.S. Pat. No. 5,692,786 by Berger; U.S. Pat. No. 6,007,119 by Roth et al.; U.S. Pat. No. 6,135,515 by Roth et al.; U.S. Pat. No. 6,260,892 by Chang; U.S. Pat. No. 6,722,715 by Chiang; U.S. Pat. No. 6,758,504 by Mandall; and U.S. Pat. No. 6,880,868 by Brami et al.

Applicant has devised an electromagnetic lock assembly that is readily installed on a sliding double door and provides for remote operation to lock and unlock the sliding double door.

SUMMARY OF THE INVENTION

The invention is directed to an electromagnetic lock assembly adapted for locking sliding double doors having abutting edges when closed. The electromagnetic lock assembly includes an armature plate member mounted to a first sliding door. An electromagnetic body member is mounted to a second sliding door. The armature plate member and electromagnetic body member are in register contact with the sliding double doors closed. The electromagnetic body member includes an electrical conductor portion movably contacting a stationary, linear power strip member mounted to a nonmoving support adjacent to the second sliding door. Electrical power is maintained to the electromagnetic body member of the lock assembly by the electrical conductor portion thereof movably contacting the stationary power strip member upon movement of the sliding double doors.

In a preferred embodiment of the invention, the electromagnetic lock assembly for locking sliding double doors having abutting edges when closed includes an armature plate member vertically mounted through an L-shaped bracket member to a first sliding door adjacent an abutting edge thereof. An electromagnetic body member is vertically mounted through another L-shaped bracket member to a second sliding door adjacent an abutting edge thereof. The armature plate member and electromagnetic body member are in register contact with the sliding double doors closed. The electromagnetic body member includes an electrical conductor portion movably contacting a stationary, linear power strip member mounted to a nonmoving support adjacent an upper edge of the second sliding door. Electrical power is maintained to the electromagnetic body member of the lock assembly by the electrical conductor portion thereof, movably contacting the stationary power strip member upon movement of the sliding double doors.

In a most preferred embodiment of the invention, the stationary, linear power strip member includes a pair of exposed conductors along essentially the length thereof and the electrical conductor portion includes a pair of contact members, each movably contacting one of the pair of exposed conductors of the power strip member. Most preferably, the pair of contact members is selected from the group consisting of wheels or rollers, brushes, pins, and balls, and is biased toward the power strip member

DESCRIPTION OF THE EMBODIMENTS

Nomenclature

10 Electromagnetic Lock Assembly
20 Armature Plate Member
22 Contact Surface of Armature Plate Member
30 Electromagnetic Body Member
32 Contact Surface of Electromagnetic Body Member
34 Power Cord of Electromagnetic Body Member
40 Electrical Conductor Portion of Electromagnetic Body Member
50 L-Shaped Mounting Brackets
52 Screw Apertures of L-Shaped Mounting Brackets
54 Adjustment Bracket Mounting Apertures
60 Linear Power Strip Member
62 Channels in Power Strip Member
64 Exposed Conductors of Power Strip Member
66 Electrical Cord of Power Strip Member
68 Mounting Apertures of Power Strip Member
70 Electrical Contact Members
72 Wheel Contact Members
74 Brush Contact Members
76 Pin Contact Members
78 Ball Contact Members
80 Biasing Spring for Contact Members
90 Adjustment Bracket Member of Electrical Contact Portion
92 Mounting Slot
95 Adjustment Screws for Bracket
A Abutting Edge of Sliding Door
D Sliding Doors
P Access Panel for Doors
S Sensor for Operating Doors

Construction

The invention is an electromagnetic lock assembly adapted for locking sliding double doors having abutting edges when closed. The electromagnetic lock assembly includes an armature plate member mounted to a first sliding door. An electromagnetic body member is mounted to a second sliding door. The armature plate member and electromagnetic body member are in register contact with the sliding double doors closed. The electromagnetic body member includes an electrical conductor portion movably contacting a stationary, linear power strip member mounted to a nonmoving support adjacent to the second sliding door. Electrical power is maintained to the electromagnetic body member of the lock assembly by the electrical conductor portion thereof movably contacting the stationary power strip member upon movement of the sliding double doors.

In a preferred embodiment of the invention, the electromagnetic lock assembly for locking sliding double doors having abutting edges when closed includes an armature plate member vertically mounted through an L-shaped bracket member to a first sliding door adjacent an abutting edge thereof. An electromagnetic body member is vertically mounted through another L-shaped bracket member to a second sliding door adjacent an abutting edge thereof. The armature plate member and electromagnetic body member are in register contact with the sliding double doors closed. The electromagnetic body member includes an electrical conductor portion movably contacting a stationary, linear power strip member mounted to a nonmoving support adjacent an upper edge of the second sliding door. Electrical power is maintained to the electromagnetic body member of the lock assembly by the electrical conductor portion thereof, movably contacting the stationary power strip member upon movement of the sliding double doors.

Figure 1:
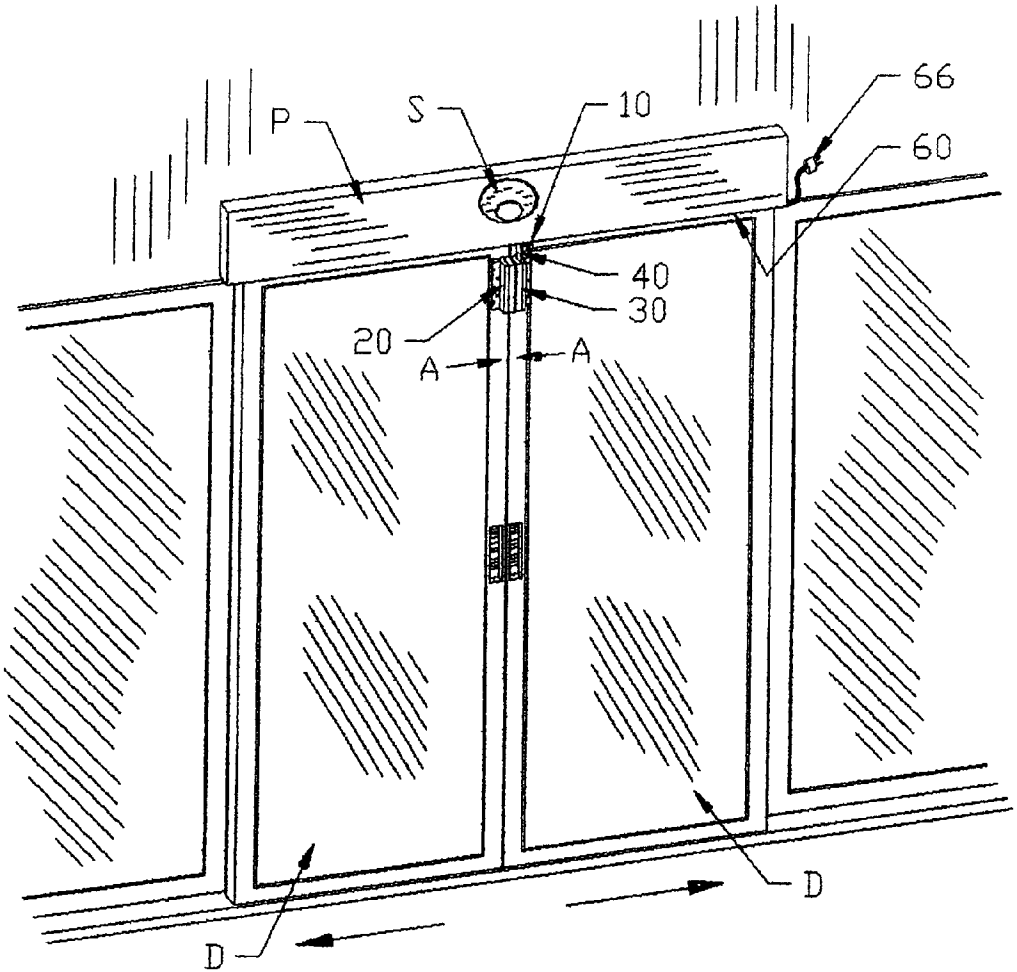
FIG. 1 is a perspective view of the electromagnetic lock assembly of the present invention installed on sliding double doors.

Referring now to FIG. 1, the electromagnetic lock assembly 10 is shown installed on sliding double doors D having abutting edges A when the doors D are closed. The double doors D are activated to slide apart in a common plane, for example, by an optical sensor S mounted on a stationary wall or an access panel P for the door electronics, located above the sliding double doors D or a footplate (not shown) adjacent the sliding double doors D.

Figure 2:
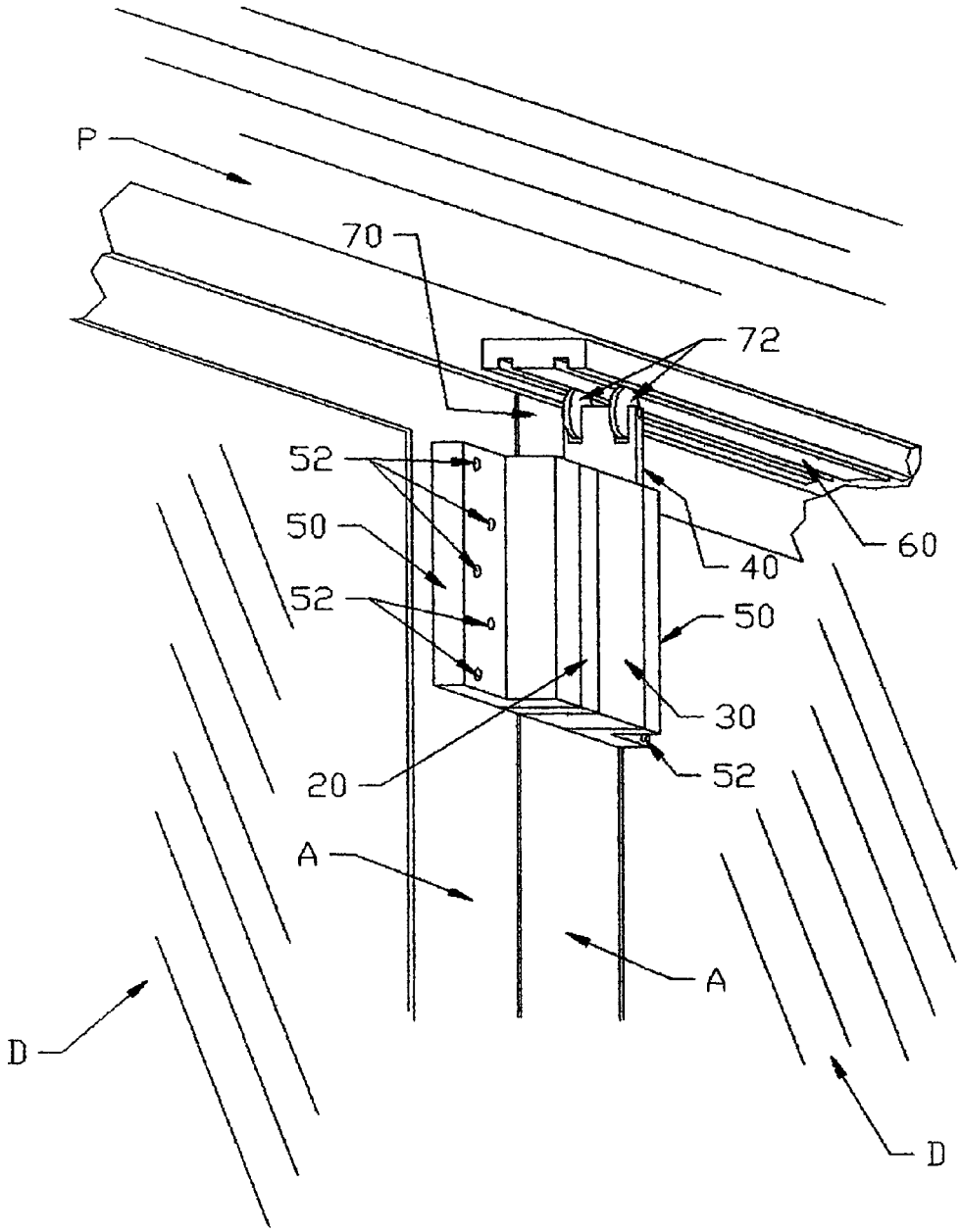
FIG. 2 is an enlarged, perspective view of a preferred embodiment of the electromagnetic lock assembly of the present invention installed on sliding double doors.
Figure 3:
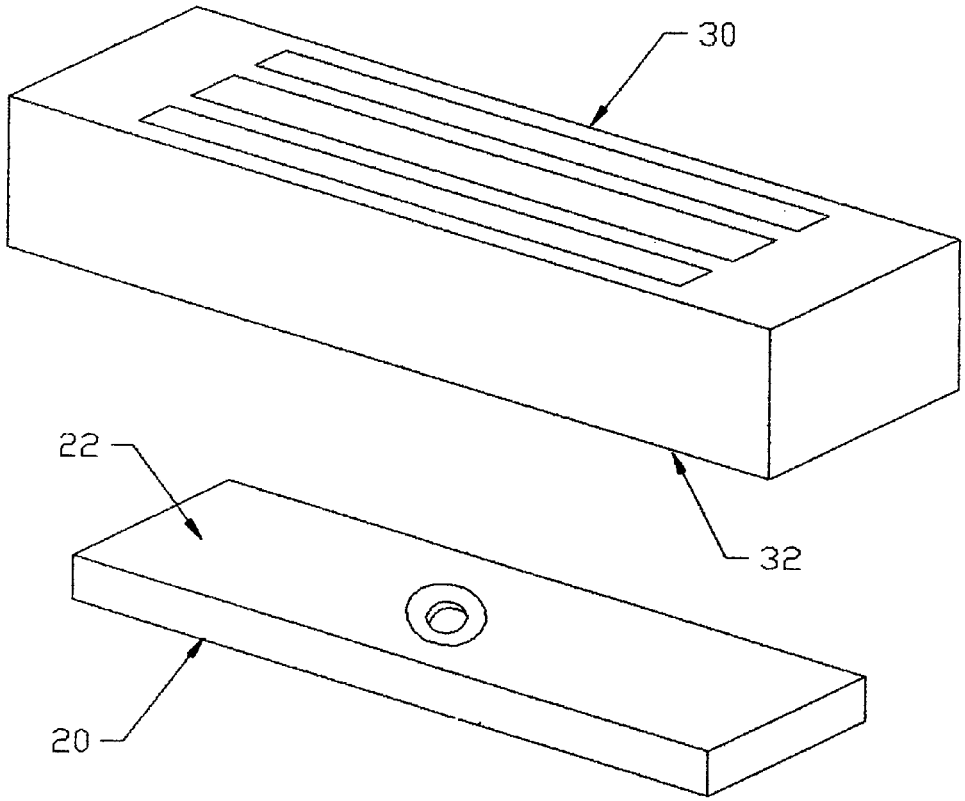
FIG. 3 is a perspective view of the armature plate member and electromagnetic body member of the electromagnetic lock assembly of the present invention.

FIG. 2 provides greater detail of the electromagnetic lock assembly 10 installed on sliding double doors D near the top edges of the double doors D, adjacent the abutting edges A thereof. The lock assembly 10 includes an armature plate member 20, which is vertically mounted to a first sliding door D adjacent an abutting edge A thereof. An electromagnetic body member 30 is vertically mounted to a second sliding door D adjacent an abutting edge A thereof. The armature plate member 20 and electromagnetic body member 30 are typically rectangular, as illustrated in FIG. 3, and vertical mounting indicates that the long axis of each member 20, 30 is vertical, as illustrated in FIG. 2. The armature plate member 20 has a contact surface 22 that engages the contact surface 32 of the electromagnetic body member 30, in register, as the sliding double doors D close. Energizing the electromagnetic body member 30 provides a strong magnetic attraction between the two members 20, 30 to lock the sliding double doors D. The "in register" approach of the armature plate member 20 and the electromagnetic body member 30 avoids the problems associated with "shear lock" approach of the two members 20, 30.

Alternatively, the armature plate member 20 and electromagnetic body member 30 are each mounted adjacent the bottom edge of one of the sliding doors D. Another alternative is mounting the armature plate member 20 within the abutting edge A of one door D, and electromagnetic body member 30 within the abutting edge A of the other door D, such that the two members 20, 30 approach each other "in register" as the sliding double doors D close.

Figure 4:
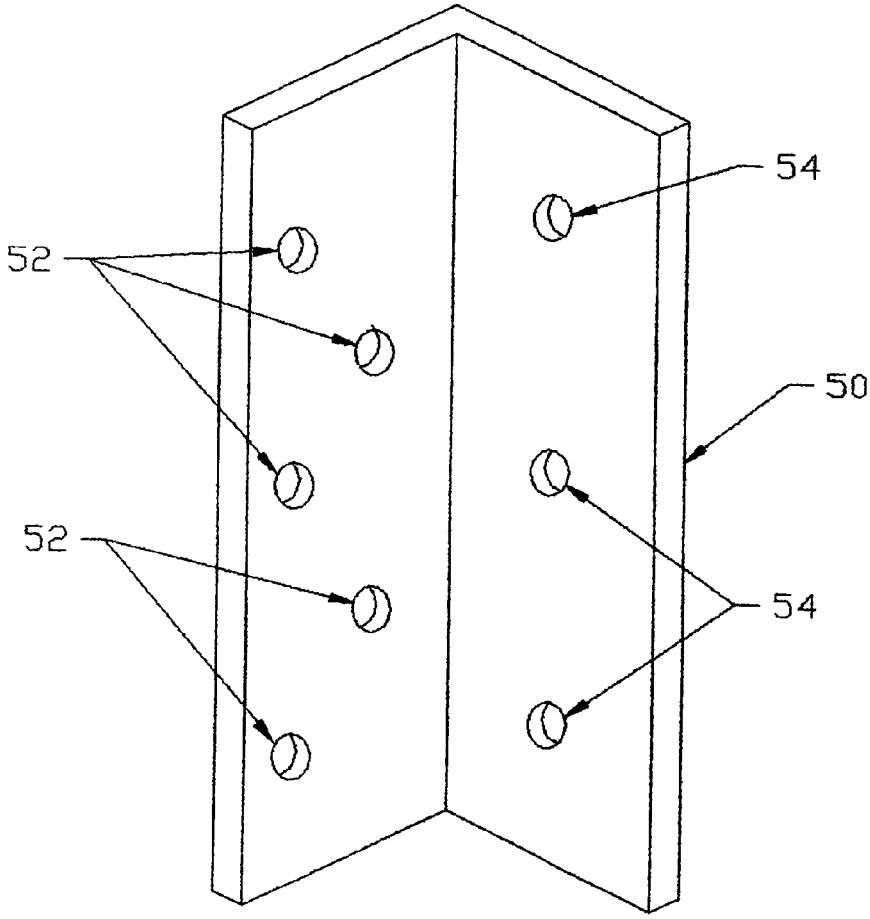
FIG. 4 is a perspective view of the L-shaped mounting bracket of the present invention.

In a preferred embodiment of the invention, the armature plate member 20 is vertically mounted to the first sliding door D through an L-shaped bracket member 50 secured adjacent the abutting edge A thereof. Likewise, the electromagnetic body member 30 is vertically mounted to the second sliding door D through another L-shaped bracket member 50 secured adjacent the abutting edge A thereof, as illustrated in FIG. 2. The L-shaped bracket members 50, shown in detail in FIG. 4, each include screw apertures 52 for securing the bracket member 50 to the surface of the sliding door D, as well as screw apertures 54 for attachment of the armature plate member 20 or the electromagnetic body member 30. An L-shaped bracket member 50 is fastened to the armature plate member 20 or the electromagnetic body member 30 by screw fasteners or by other suitable fastening means, such as an adhesive. Other techniques for attaching the armature plate member 20 and electromagnetic body member 30 to the pair of sliding doors D are also contemplated with equivalent results.

Figure 5:
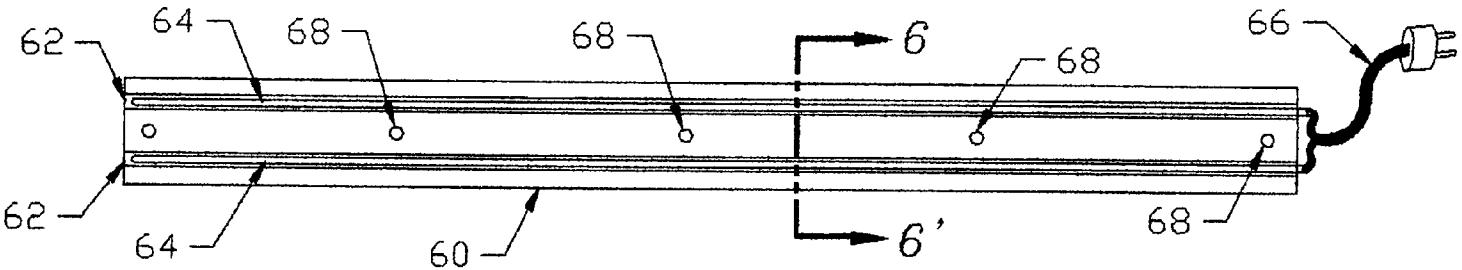
FIG. 5 is a perspective view of the linear power strip member of the present invention.
Figure 6:
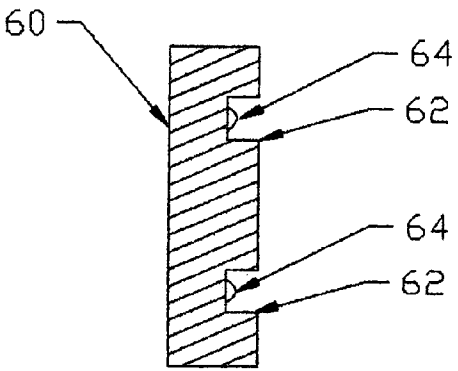
FIG. 6 is a cross sectional view of the power strip member along line 6-6' of FIG. 5 of the present invention.

Referring again to FIG. 2, the electromagnetic body member 30 includes an electrical conductor portion 40 movably contacting a stationary, linear power strip member 60 mounted to a nonmoving support surface adjacent an upper edge of the second sliding door D, such as the access panel P or other portion of the door frame. The electrical conductor portion 40 extends upwardly from the electromagnetic body member 30 to contact the power strip member 60, which includes a pair of full length channels 62 each containing an exposed conductor 64 along essentially the length thereof, as shown in FIG. 5. The power strip member 60 includes a series of apertures 68 for fastening the power strip member 60 to the support surface using suitable fasteners (not shown). A cross section of the power strip member 60 is illustrated in FIG. 6. The conductors 64 extend from one end of the power strip member 60 and are connected to a power source via a suitable plug 66, or comparable electrical connection. The body of the power strip member 60 is formed of a non-conducting, insulating material, such as polymer plastic. The conductors 64 are enclosed in an insulating sheath beyond the power strip member 60 and are connected to a conventional power supply. The power supply can be either alternating current (AC) or direct current (DC) as disclosed below.

In an alternative configuration, with the armature plate member 20 and electromagnetic body member 30 secured adjacent the bottom edges of each door D, or even secured within the abutting edge A of each door D, the power strip member 60 may be embedded into the channel in which the sliding door D containing the electromagnetic body member 30 travels. Regardless of the location of the armature plate member 20 and electromagnetic body member 30 on or within the doors D, the power strip member 60 need only apply power to electromagnetic body member 30 as it approaches and contacts the armature plate member 20 to effect locking of the sliding double doors D.

Figure 7:
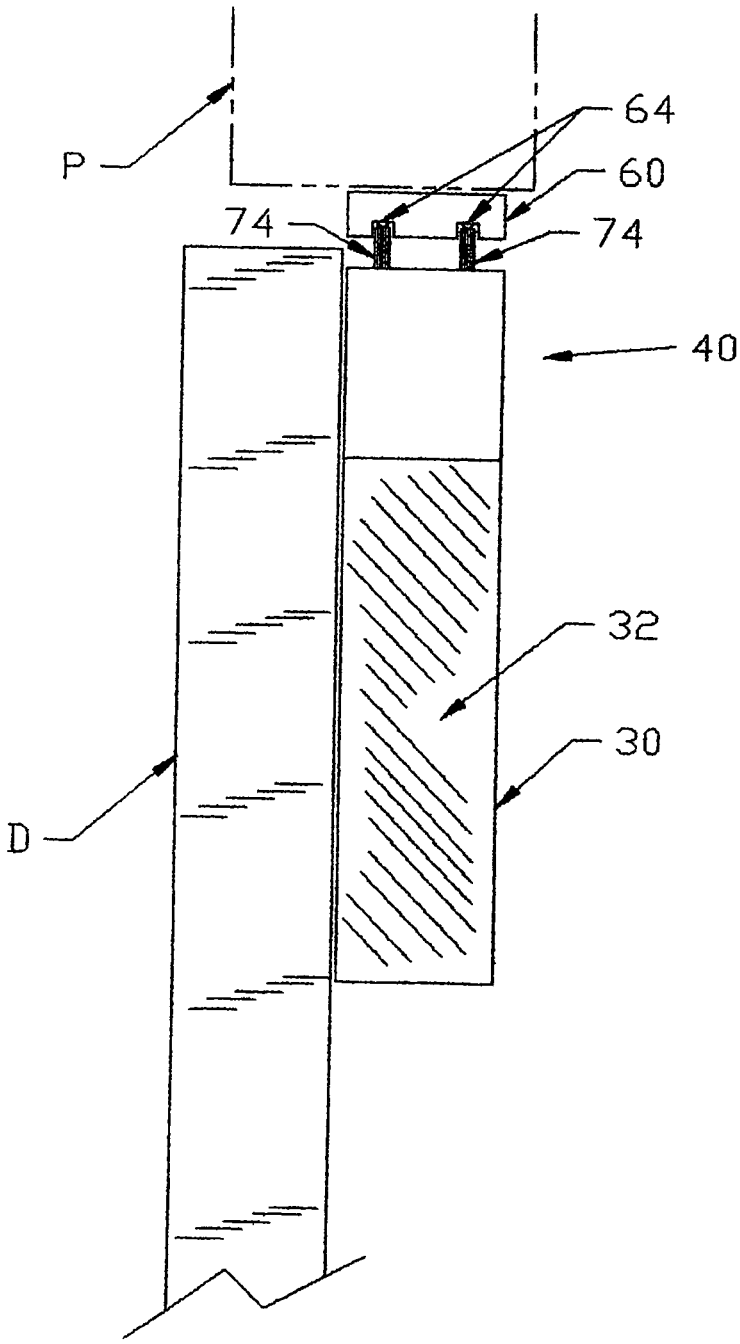
FIG. 7 is a perspective side view of one embodiment of the electromagnetic body member engaging the power strip member of the present invention.
Figure 8:
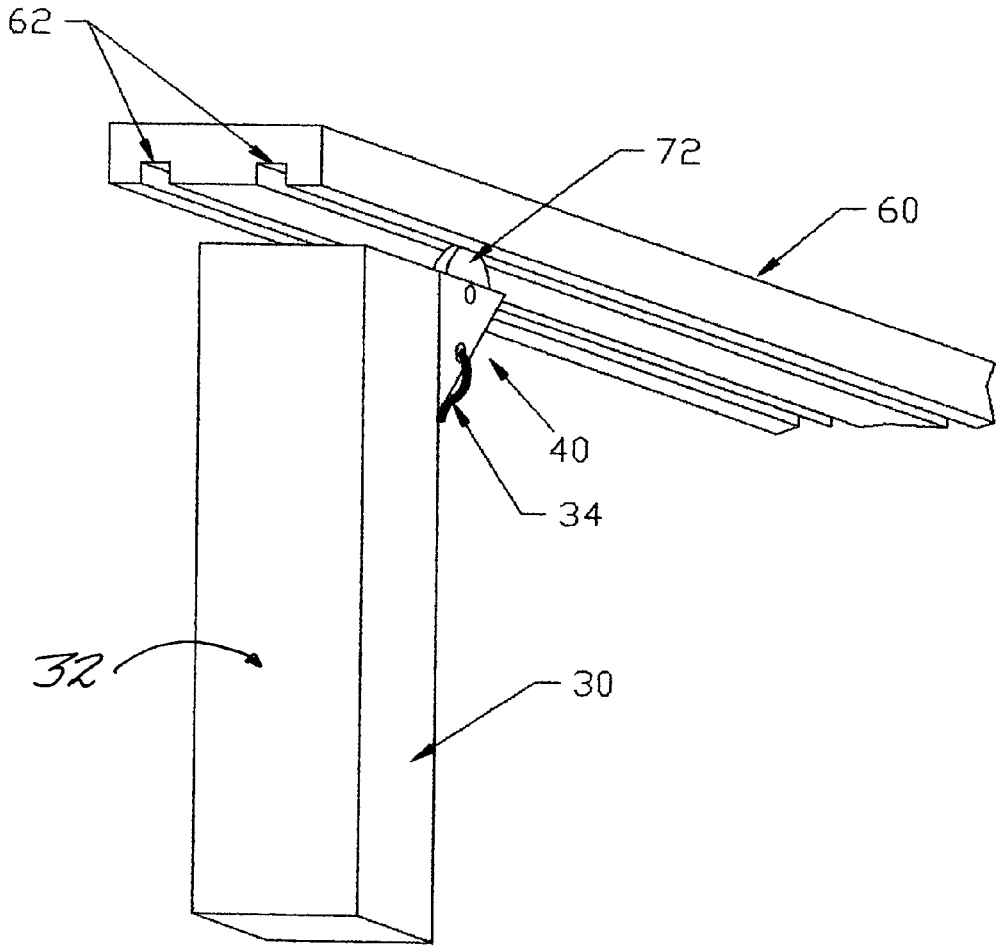
FIG. 8 is a perspective view of an alternative embodiment of the electromagnetic body member engaging the power strip member of the present invention.

The electrical conductor portion 40 of the electromagnetic body member 30 includes a pair of contact members 70, shown in FIG. 2, each contact member 70 movably contacting one of the pair of exposed conductors 64 of the power strip member 60, as shown in FIG. 7. The contact members 70 can include a pair of wheels or rollers 72 (FIG. 2), brushes 74 (FIG. 7), pins 76 (FIG. 7), or balls 78 (FIG. 8). Electrical power is routed from the contact members 70 to the electromagnetic body member 30 by a power cord 34, best seen in FIGS. 8 and 9. Thus, electrical power is maintained to the electromagnetic body member 30 of the lock assembly 10 by the electrical conductor portion 40 movably contacting the stationary power strip member 60 upon movement of the sliding double doors D.

As mentioned above, the power supply to the power strip member 60 can be either alternating current (AC) or direct current (DC). The power supply can include a step down transformer that converts household current of 110 volts to low voltage DC, 12VDC, or AC, 24VAC. These low voltages are the type typically used to operate such electromagnetic lock assemblies 10. Certain of the commercially available electromagnetic body members 30 contain units called "jumpers" that accept either AC or DC power to operate the lock assembly 10.

Figure 9:
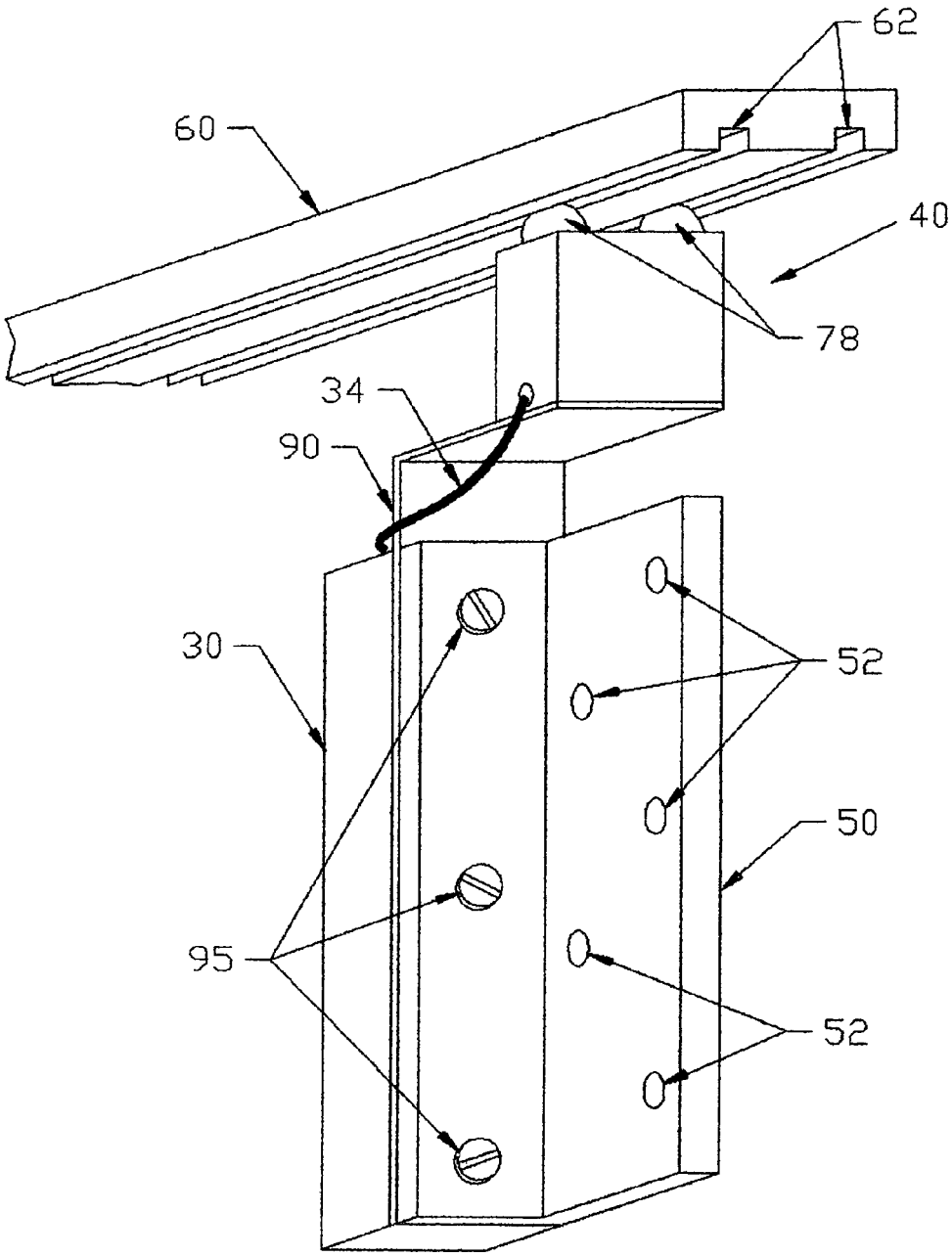
FIG. 9 is a perspective side view of yet another embodiment of the electromagnetic body member engaging the power strip member of the present invention.
Figure 10:
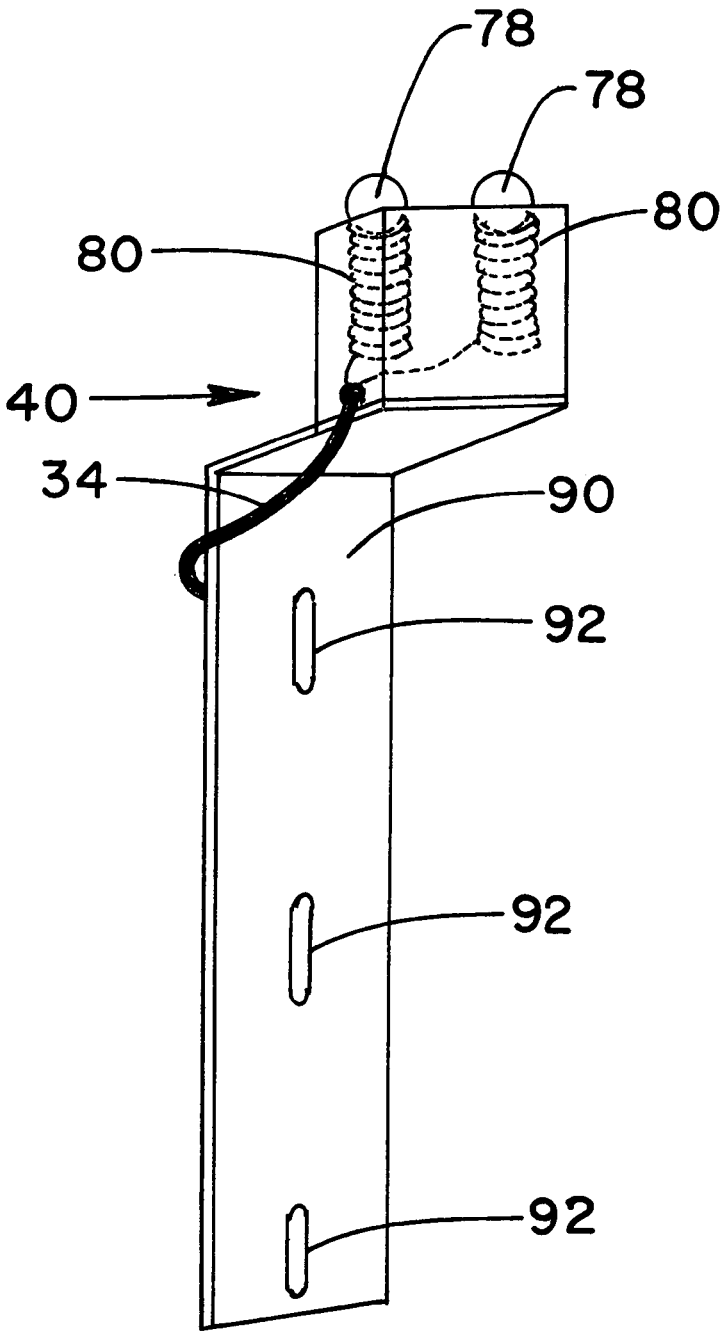
FIG. 10 is a perspective side view of the adjustment bracket member of the electrical contact portion of the electromagnetic body member of the present invention.

In a preferred embodiment of the invention, the electrical conductor portion 40 is adjustable relative to the electromagnetic body member 30 and the pair of electrical contact members 70 is biased toward the power strip member 60 to ensure constant contact there between. For example, as illustrated in FIGS. 9 and 10, an adjustment bracket member 90 is provided for the electrical conductor portion 40 to allow adjustable positioning of the electrical conductor portion 40 between the power strip member 60 and the electromagnetic body member 30. The adjustment bracket member 90 includes a plurality of mounting slots 92 for accepting mounting screws 95 to secure the bracket member 90 to the L-shaped mounting bracket 50 via the apertures 54. Additionally, the electrical contact member 70, such as brush contacts 74, are each spring biased by springs 80 to maintain continuous contact with the electrical conductors 64 of the power strip member 60 as the electrical contact members 70 move along within the channels 62 of the power strip member 60.

A further feature of the power strip member 60 is the ability to be cut to a selected length for use in all applications. The power strip member 60 is shortened by simply cutting off a portion of the strip member 60 from the end opposite the electrical cord 66. This feature adds versatility to the electromagnetic lock assembly 10 of the present invention.

While the invention has been particularly shown and described with reference to preferred embodiments thereof, it will be understood by those skilled in the art that various changes in form and details may be made therein without departing from the spirit and scope of the invention.

I claim:

1. An electromagnetic lock assembly for locking sliding double doors having abutting vertical edges when closed, the electromagnetic lock assembly comprising:

an armature plate member mounted parallel to and adjacent an abutting vertical edge of a first sliding door;

an electromagnetic body member mounted parallel to and adjacent an abutting vertical edge of a second sliding door, the armature plate member and electromagnetic body member positioned in register and in contact with the sliding double doors closed; and the electromagnetic body member including an electrical conductor portion movably contacting a stationary, linear power strip member adapted for mounting to a non-moving support adjacent to the second sliding door;

whereby electrical power is maintained to the electromagnetic body member of the lock assembly by the electrical conductor portion thereof movably contacting the stationary power strip member upon movement of the sliding double doors, the electromagnetic body member selectively energized whereby contact thereof with the armature plate member locks together the sliding double doors.

2. The electromagnetic lock assembly of claim 1, wherein the stationary, linear power strip member includes a pair of exposed conductors along essentially the length thereof and the electrical conductor portion includes a pair of contact members, each movably contacting one of the pair of exposed conductors of the power strip member.

3. The electromagnetic lock assembly of claim 2, wherein each exposed conductor is positioned in an individual channel of the power strip member.

4. The electromagnetic lock assembly of claim 2, wherein the pair of contact members is selected from the group consisting of wheels, rollers, brushes, pins, and balls.

5. The electromagnetic lock assembly of claim 2, wherein the pair of contact members is each biased by a spring member toward the power strip member.

6. The electromagnetic lock assembly of claim 1, wherein the electrical conductor portion is adjustable relative to the electromagnetic body member.

7. The electromagnetic lock assembly of claim 1, wherein the armature plate member is mounted to the first sliding door through an L-shaped bracket member, and the electromagnetic body member is mounted to the second sliding door through another L-shaped bracket member.

8. An electromagnetic lock assembly for locking sliding double doors having abutting vertical edges when closed, the electromagnetic lock assembly comprising:

an armature plate member mounted through an L-shaped bracket member parallel to and adjacent an abutting vertical edge of a first sliding door;

an electromagnetic body member mounted through another L-shaped bracket member parallel to and adjacent an abutting vertical edge of a second sliding door, the armature plate member and electromagnetic body member positioned in register and in contact with the sliding double doors closed; and the electromagnetic body member including an electrical conductor portion movably contacting a stationary, linear power strip member adapted for mounting to a non-moving support adjacent to the second sliding door;

whereby electrical power is maintained to the electromagnetic body member of the lock assembly by the electrical conductor portion thereof movably contacting the stationary power strip member upon movement of the sliding double doors, the electromagnetic body member selectively energized whereby contact thereof with the armature plate member locks together the sliding double doors.

9. The electromagnetic lock assembly of claim 8, wherein the stationary, linear power strip member includes a pair of exposed conductors along essentially the length thereof and the electrical conductor portion includes a pair of contact members, each movably contacting one of the pair of exposed conductors of the power strip member.

10. The electromagnetic lock assembly of claim 9, wherein each exposed conductor is positioned in an individual channel of the power strip member.

11. The electromagnetic lock assembly of claim 9 wherein the pair of contact members is selected from the group consisting of wheels, rollers, brushes, pins, and balls.

12. The electromagnetic lock assembly of claim 9, wherein the pair of contact members is each biased by a spring member toward the power strip member.

13. The electromagnetic lock assembly of claim 8, wherein the electrical conductor portion is adjustable relative to the electromagnetic body member.

14. An electromagnetic lock assembly for locking sliding double doors having abutting vertical edges when closed, the electromagnetic lock assembly comprising:

an armature plate member mounted through an L-shaped bracket member parallel to and adjacent an abutting vertical edge of a first sliding door;

an electromagnetic body member mounted through an L-shaped bracket member parallel to and adjacent an abutting vertical edge of a second sliding door, the armature plate member and electromagnetic body member positioned in register and in contact with the sliding double doors closed; and the electromagnetic body member including an electrical conductor portion movably contacting a stationary, linear power strip member adapted for mounting to a non-moving support adjacent an upper edge of the second sliding door, the stationary, linear power strip member including a pair of exposed conductors along essentially the length thereof and the electrical conductor portion including a pair of contact members, each movably contacting one of the pair of exposed conductors of the power strip member, the electrical conductor portion adjustable relative to the electromagnetic body member;

whereby electrical power is maintained to the electromagnetic body member of the lock assembly by the electrical conductor portion thereof movably contacting the stationary power strip member upon movement of the sliding double doors, the electromagnetic body member selectively energized whereby contact thereof with the armature plate member locks together the sliding double doors.

15. The electromagnetic lock assembly of claim 14, wherein each exposed conductor is positioned in an individual channel of the power strip member.

16. The electromagnetic lock assembly of claim 14, wherein the pair of contact members is selected from the group consisting of wheels, rollers, brushes, pins, and balls.

17. The electromagnetic lock assembly of claim 14, wherein the pair of contact members is each biased by a spring member toward the power strip member.

* * * * *